US005163167A

United States Patent [19]

Heil

[11] Patent Number: 5,163,167

[45] Date of Patent: Nov. 10, 1992

[54] SOUND WAVE GUIDE

[75] Inventor: Christian Heil, Gometz Le Chatel, France

[73] Assignee: Heil Acoustics, Gometz La Ville, France

[21] Appl. No.: 316,919

[22] Filed: Feb. 28, 1989

[30] Foreign Application Priority Data

Feb. 29, 1988 [FR] France ..... 88 02481

[51] Int. Cl.[5] ..... G10K 11/22

[52] U.S. Cl. ..... 181/152; 181/159; 181/185; 181/192

[58] Field of Search ..... 181/148, 152, 159, 185, 181/187, 177, 192

[56] References Cited

U.S. PATENT DOCUMENTS

| | | | |
|---|---|---|---|
| 3,980,829 | 9/1976 | Beveridge | 181/176 X |
| 4,091,891 | 5/1978 | Hino et al. | 181/185 |
| 4,171,734 | 10/1979 | Peveto et al. | 181/192 |
| 4,181,193 | 1/1980 | Isaac | 181/185 |
| 4,344,504 | 8/1982 | Howze | 181/187 |
| 4,390,078 | 6/1983 | Howze et al. | 181/185 |
| 4,713,799 | 12/1987 | Phelan et al. | 181/185 X |
| 4,718,517 | 1/1988 | Carlson | 181/159 |
| 4,776,428 | 10/1988 | Belisle | 181/159 X |

FOREIGN PATENT DOCUMENTS 757021 9/1956 United Kingdom .

*Primary Examiner*—Benjamin R. Fuller
*Assistant Examiner*—David Yockey
*Attorney, Agent, or Firm*—Sandler, Greenblum & Bernstein

[57] ABSTRACT

A wave guide fitted at the output of a loudspeaker, in front of the membrane or in front of the orifice of a compression chamber, along the axis of the transducer being considered, and comprising a conduit which expands from its input to its output. The area of the output orifice of the wave guide is planar and oblong, that its conduit comprises a passage between the input orifice and the output area, adapted to guide the waves along a general direction from which the shortest paths allowed in the one or more passages are all of lengths which are practically identical from the input orifice to the output orifice of the conduit. The invention is for use in providing sound to large areas.

34 Claims, 6 Drawing Sheets

SOUND WAVE GUIDE

BACKGROUND OF THE INVENTION

1. Field of the Invention

The present invention relates to the optimization of acoustical couplings between neighboring electro-acoustical transducers, over the entire extent of their frequency spectrum, by means of a particular wave guide. This wave guide aims to transform a planar circular isophase (membrane of a loudspeaker or output of a compression chamber) wave surface into an isophase planar rectangular wave surface. The alignment of a plurality of rectangular surfaces thus formed constitutes a planar isophase band from which a coherent cylindrical progressive wave can emerge. A plurality of transducers coupled together thus will generate a coherent cylindrical wave, while the same transducers without the wave guide of the invention generate many spherical progressive waves interfering with one another.

2. Description of Background and Relevant Information

The sound wave guide comprises a circular input and a rectangular output of such a type that the time internal between the input and the output of the wave propagation remains constant, independent of the acoustical path.

The wave guide is fitted in front of a loudspeaker or an orifice of a compression chamber along the axis of the transducer being considered, and comprises a conduit which expands from the input until an output area characterized by the planar and oblong area of the output orifice of the wave guide, such that its conduit comprises one or more passages between the input orifice and the output area assumes the general form of a sheet, and that the shortest paths allowed in the one or more passages are all of practically equal length from the input orifice to the output orifice of the conduit.

SUMMARY OF THE INVENTION

The present invention is directed to a wave guide fitted at the output of a loudspeaker in front of a membrane or in front of the orifice of a compression chamber, along the axis of the transducer, and comprises a conduit which expands from an input orifice to an output orifice, with the output orifice being substantially oblong and planar. The conduit comprises at least one passage between the input orifice and the output orifice adapted to guide the waves along a path such that the shortest paths allowed in the at least one passage are all of practically equal lengths from the input orifice to the output orifice of the conduit.

According to a further aspect of the invention, the shape of at least one passage is defined by the shape of the walls of the conduit.

According to a further aspect of the invention, the shape of the at least one passage is obtained by incorporating one or more internal bodies within the conduit.

According to a further aspect, the shape of the at least one passage is defined by the respective shapes of the conduit and one or more internal bodies within the conduit.

According to a further aspect, the wave guide comprises three elements, two shells that are symmetrical along a vertical plane between which one or more internal bodies are affixed, and each shell comprises a rear side plate and front side plate connected by a cross beam plate shaped to determine the housing of one or more internal bodies.

According to a further aspect, the wave guide comprises rear side plates which are situated so as to extend from one another, and they each comprise a small circular cut-out portion facing each other after assembly, to determine the input orifice.

According to a further aspect, the wave guide comprises front side plates which are situated so as to extend from one another, and they each comprise a cut-out portion facing each other to form a rectangular slot after assembly, to determine the output orifice.

According to a further aspect, the wave guide comprises one or more internal bodies having the general shape of a flattened cone or of a flattened diamond, with a front end point penetrating the input orifice and a rear end beveled in a manner such that the end's edge is continuous with and along the axis of the output orifice of the conduit in the shape of the slot.

According to a further aspect, the one or more internal bodies are secured to the conduit by means of one or more small tongues which are parallel to the conduit's axis, so as to regularly maintain the spacing of the walls of the conduit.

According to a further aspect, several wave guides are mounted in a line, each at the respective output of a loudspeaker, in a manner such that the oblong areas of the slots of the respective output orifices are each located in the same plane and in extension with each other.

The invention can be further defined as an energy directing means transforming a planar circular wave surface into a planar rectangular wave surface, over the circular wave's entire frequency spectrum, comprising an input orifice for receiving the circular wave surface, an output orifice having a generally rectangular shape, and one or more passages extending from the input orifice to the output orifice.

According to a further aspect, several devices are aligned to create a planar band which forms a coherent cylindrical progressive wave.

According to a further aspect, the time interval of energy propagation of the one or more passages between the input orifice and the output orifice remains constant, and the shortest paths of one or more passages are of practically equal length.

According to a further aspect, the invention includes the combination of a device with a loudspeaker having a compression chamber, with the device having two ends, one end fitted to a membrane of the loudspeaker, such that the output of the loudspeaker is a planar circular wave, and the other end comprises the output orifice, which is planar and oblong.

According to a further aspect, in the combination of a device with a loudspeaker having an annular diaphragm, with the device having two ends, one end fitted to a membrane of the loudspeaker, the output of said compression chamber is a planar circular wave, and the other end comprises the output orifice, which is planar and oblong.

According to a further aspect, the passage is defined by a conduit which expands from the input orifice until the planar and oblong orifice of the output, with a set of rear plates comprising cut-out portions fitted to the input orifice, and a set of front plates comprising a substantially long and narrow slit for the output orifice, with the conduit being defined by one or more internal bodies.

According to a further aspect, the internal body or bodies comprises a generally flattened diamond horizontally, a generally flattened cone vertically, fixed to the conduit with continuous passages between the conduit and one or more internal bodies.

BRIEF DESCRIPTION OF THE DRAWINGS

The invention will now be described with reference to the annexed drawings given by way of non-limiting example only of a wave guide shown in the annexed drawings, in which like reference numerals are used to describe similar parts throughout the several views, and wherein.

DESCRIPTION OF PREFERRED EMBODIMENTS

The present invention is directed to a wave guide which includes a conduit having one or more internal bodies which shape the walls of the conduit.

The internal bodies can have various shapes and consist of various elements. The body can have the general appearance of a flattened diamond or a flattened cone whose point penetrates into the input orifice, and whose other end is beveled in a manner such that its edge is continuous with the output area of the conduit along the axis of the output.

Figure 1:
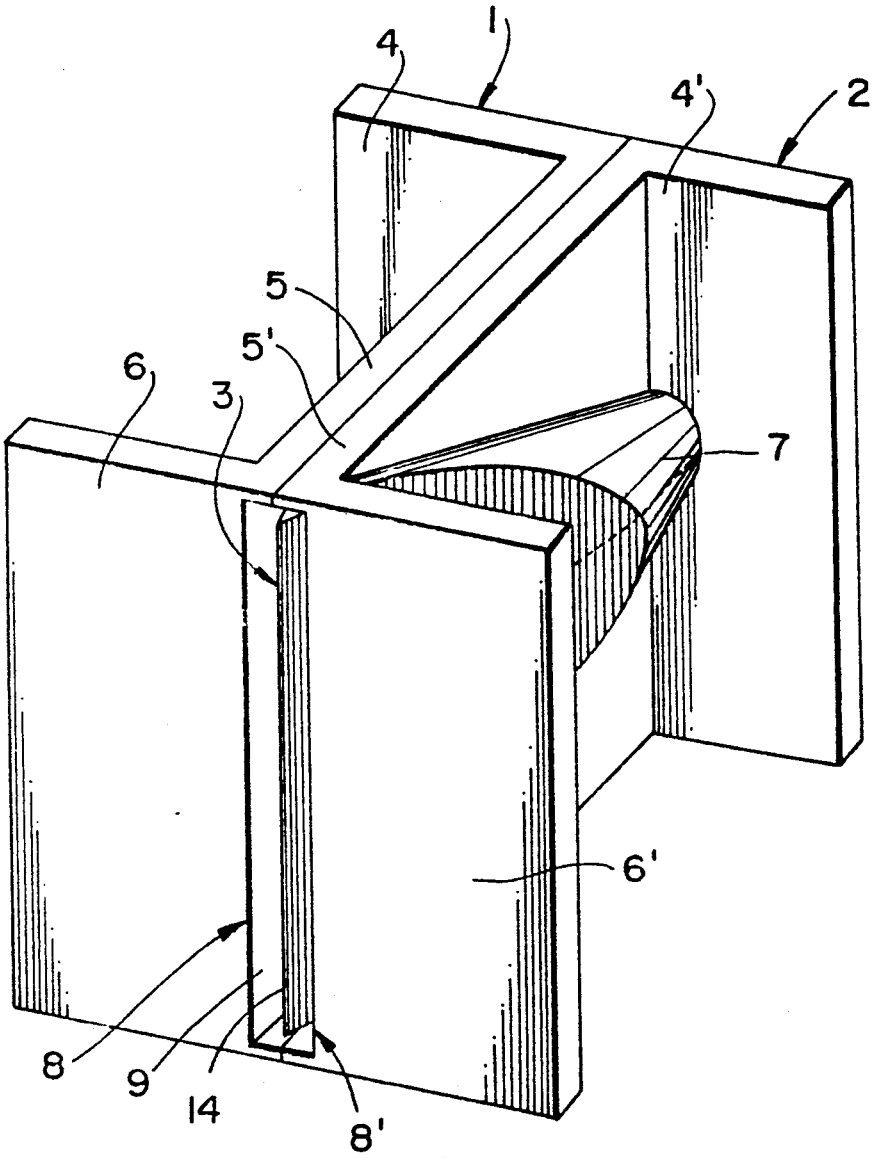
FIG. 1 is a perspective view of a wave guide.

The wave guide shown in FIG. 1 is formed of three elements 1, 2 and 3.

Elements 1 and 2 are symmetrical along a vertical plane and comprise shells between which the internal body 3 is fixed. Each shell comprises a rear side plate 4 or 4', and a front side plate 6 or 6', connected by a cross bar plate 5 or 5', with side plates 4 or 4' extending from one another. This is also true for the side plates 6 or 6', which allow a slot 9 between them, formed by the cut-out portions 8 or 8'. The hollow portions 7 or 7' form a housing for element 3.

The rear side plates 4 or 4' comprise small circular cut-out portions 10 or 10' which face one another after assembly to define the input orifice 11.

Figure 4:
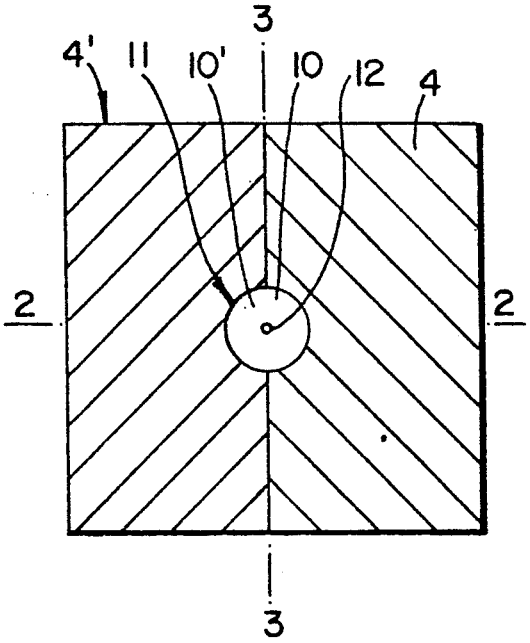
FIG. 4 is a rear view of the wave guide for a loudspeaker having a compression chamber.

FIG. 4 shows the case of a guide provided for a loudspeaker having a compression chamber, and the orifice 11, of a relatively small surface area, makes it possible to see the point 12 of the internal body 3 which will be described in detail below.

Figure 5:
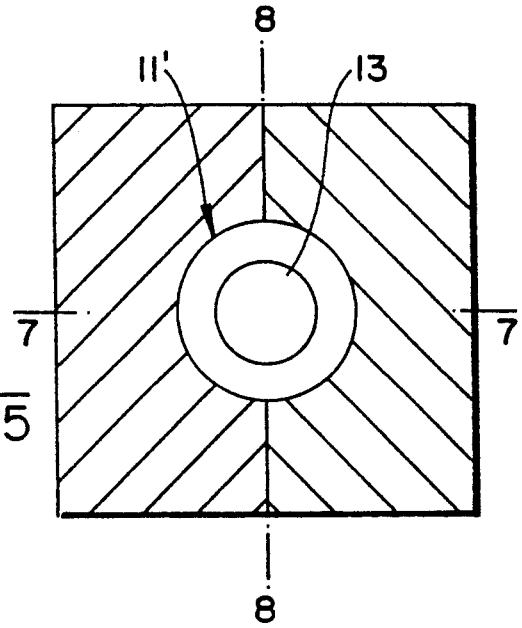
FIG. 5 is a rear view of the wave guide for a loudspeaker having an annular diaphragm.

FIG. 5 illustrates the case of a wave guide adapted for a loudspeaker having an annular diaphragm. The orifice 11' is of a surface area which is greater than in the preceding case. There is seen at 13 the end of another internal body.

Figure 6:
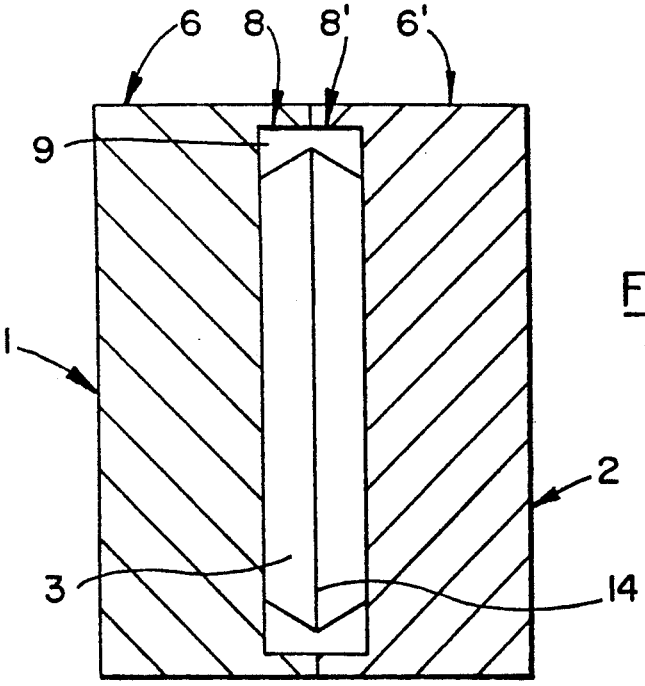
FIG. 6 is a front view of the wave guide.
Figure 7:
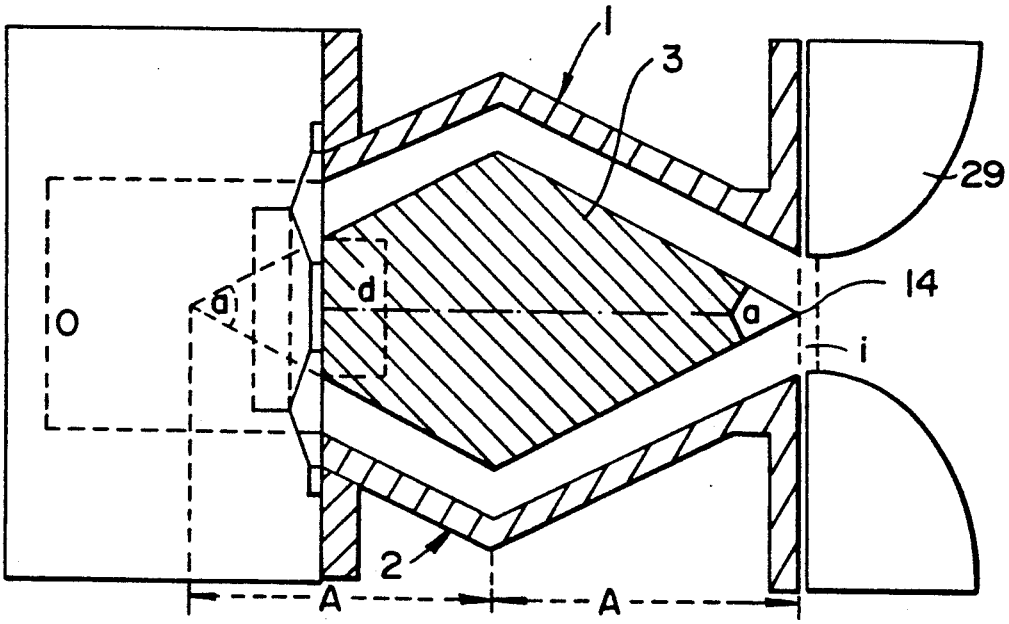
FIG. 7 is a cross-sectional view along VII—VII of FIG. 5.
Figure 8:
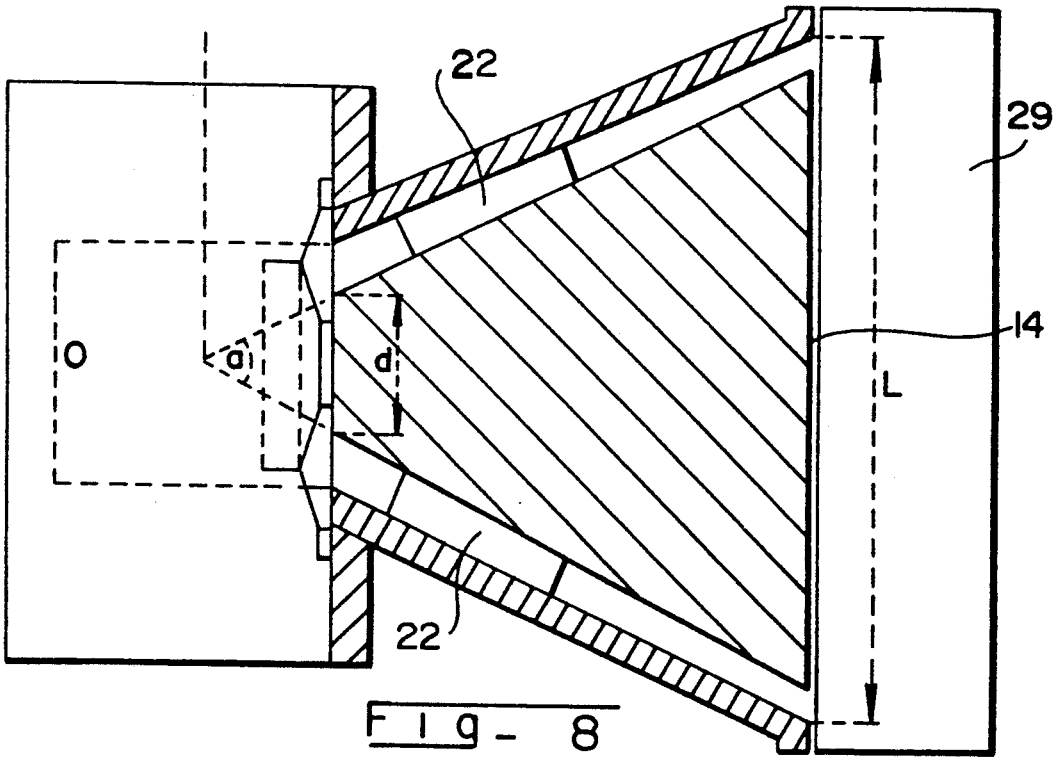
FIG. 8 is a cross-sectional view along VIII—VIII of FIG. 5.

FIG. 6 shows the front side plates 6 or 6' with their cut-out portions 8 or 8', defining the slot 9, leaving the internal body 3 with an edge 14 as an end.

Figure 2:
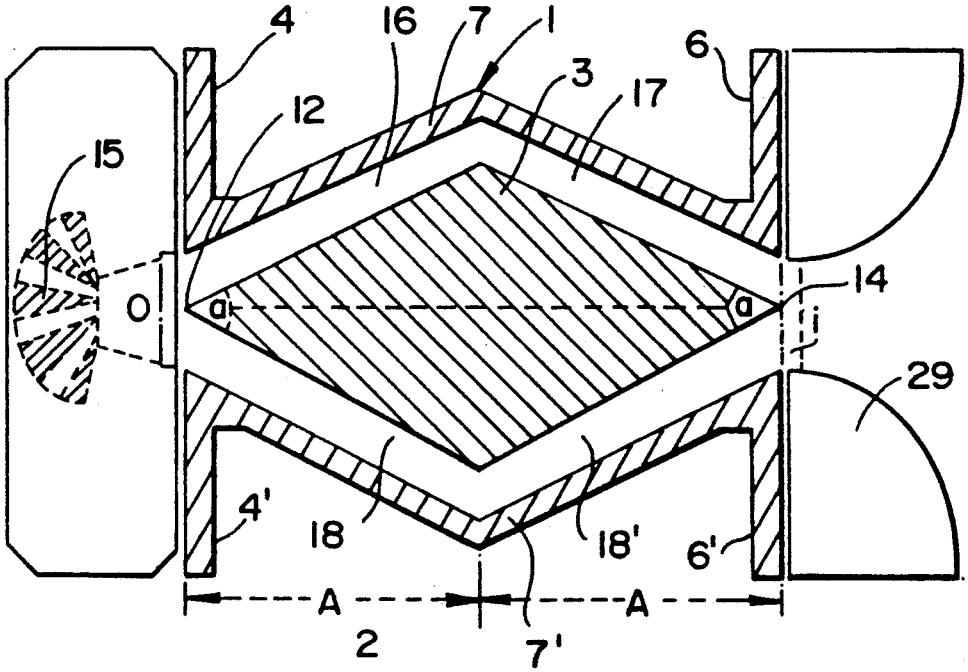
FIG. 2 is a horizontal axial cross-section view along II—II of FIG. 4.
Figure 3:
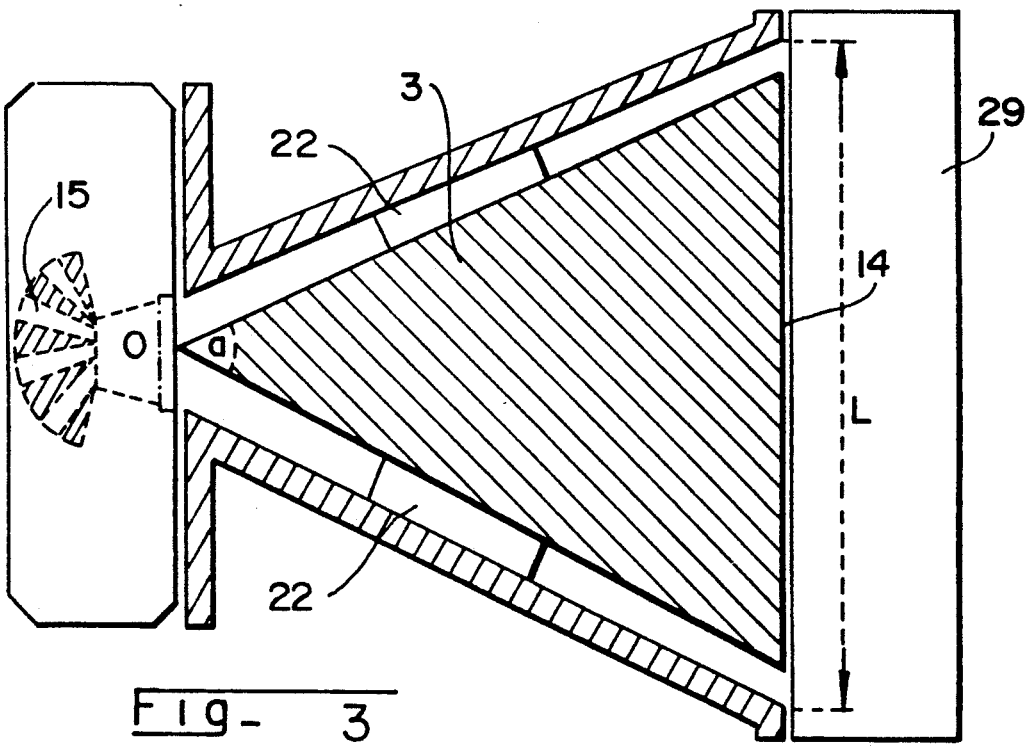
FIG. 3 is a vertical axial cross-section view along III—III of FIG. 4.

In FIGS. 2 and 3, one sees a wave guide fixed on a loudspeaker 15 and provided with a dome 29. Between the internal body 3 and the housing 7 or 7', there remains a continuous passage bearing the references 16, 17, 18 and 18'. This passage surrounds the internal body 3 on all sides, and comprises a width between housing 7, 7' and internal body 3, which is more or less constant.

Body 3 and the wall of housing 7 or 7' have shapes and dimensions which are compatible to permit a flow in the passage of the conduit provided for this purpose. In the present embodiment:

"O"=35 mm, diameter of the outlet orifice of the compression chamber;

"a"=50°, angle of the cone input and of the bevel output,

"i"=30 mm, width of the rectangular output orifice,

"L"=220 mm, height of the rectangular output orifice,

"A"=122 mm, one-half of the length of the wave guide of the invention.

It is understood that these dimensions are not limiting, but given simply by way of example to illustrate the given example.

Figure 9:
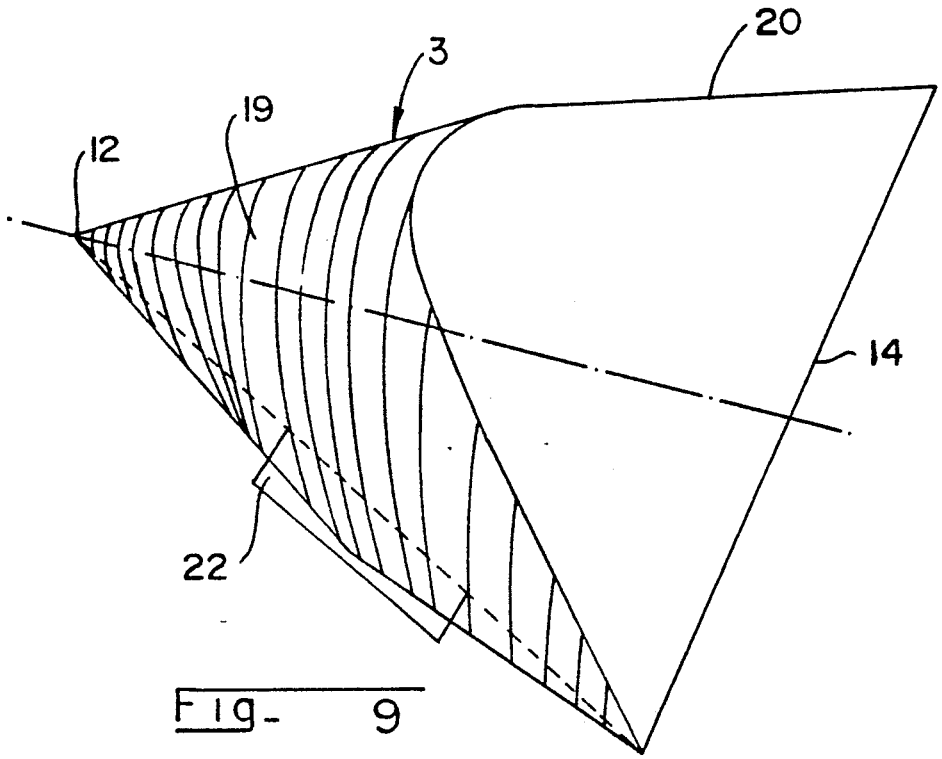
FIG. 9 shows the shape of the internal body of the wave guide in FIG. 1.
Figure 10:
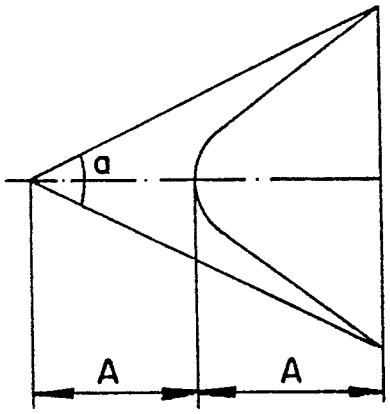
FIG. 10 is a side view of the internal body of the wave guide in FIG. 1.
Figure 11:
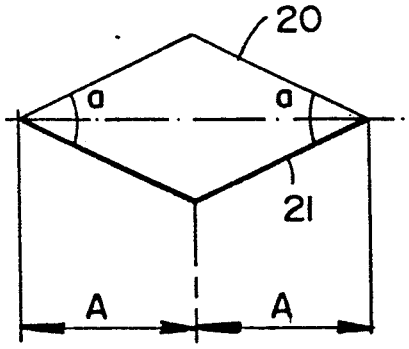
FIG. 11 is a top view of the internal body of the wave guide in FIG. 1.
Figure 12:
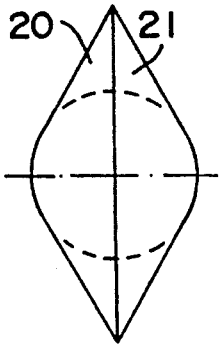
FIG. 12 is a front view of the internal body of the wave guide in FIG. 1.

The internal body 3 has a general shape of a cone 19 whose base is beveled to half of its height to determine two zones 20 and 21 determining edge 14. Body 3 takes the general shape of a flattened cone when viewed in the horizontal cross-section of FIG. 3, or a flattened diamond, when viewed in the vertical cross-section of FIG. 2, and is fixed by any known means. In FIG. 9, one sees a single small tongue 22, but there also exists a symmetrical small tongue, and during assembly, the two small tongues are sandwiched between cross bar plates 5 or 5'.

The wave guide may be of the form of a molded rigid material, such as metal, plastic, resin. As previously explained, it comprises three elements, the central element sandwiched between two identical exterior elements which determine the walls of the wave guide and comprise the affixation side plates to the loudspeaker at the input, at the dome 29 to the output. These three elements are assembled by gluing, heat welding or screws.

The shapes of the internal bodies and of the housing are such that the shortest paths from the input orifice to the output orifice are all of or nearly equal length. In the course of operation, the time of propagation of the sound wave is constant across the guide.

Thus the wave guide makes it possible to transform the isophase circular wave plane generated by the membrane of a loudspeaker or the orifice of a compression chamber into a planar rectangular isophase wave. The dimensions of the rectangular plane in question are calibrated in a manner so that the emerging sound wave propagates in the quasi-cylindrical mode.

The performance of the wave guide generally improves as a function of the frequency inputted, particularly with frequencies having a wavelength less than approximately 15 centimeters. Other performance optimization parameters include:

Either "f1", "f2", with "f2" greater than "f1", the interval of frequency over which the guide must be efficient and "lambda$_1$", "lambda$_2$", the lengths of an associated wave, or "i" and "L" respectively, the w and length of the output rectangle of the guide, "L" being the vertical side, "i" the horizontal side.

In a propagation in the cylindrical mode, the axis of the cylinder being vertical, such that the output rectangle is an isophase plane, it is necessary that the following conditions be fulfilled:

1: width of conduit less than "lambda$_2$"

2: "a" less than or equal to 30°

3: "delta" being the maximum deviation in length between the different possible acoustical paths in the guide, it is necessary that "delta"≦"lambda$_2$"4 (i.e., $\delta \leqq \lambda_2/4$).

So that the propagation effectively is cylindrical along the vertical axis, it is necessary that:

4: "L" is greater than some "lambda$_1$"

5: "i" is less than or equal to "lambda$_2$."

The range of intended use of the diffusers according to the invention is that of professional sound in auditoriums and open air spaces which require a large number of juxtaposed loudspeakers.

Figure 13:
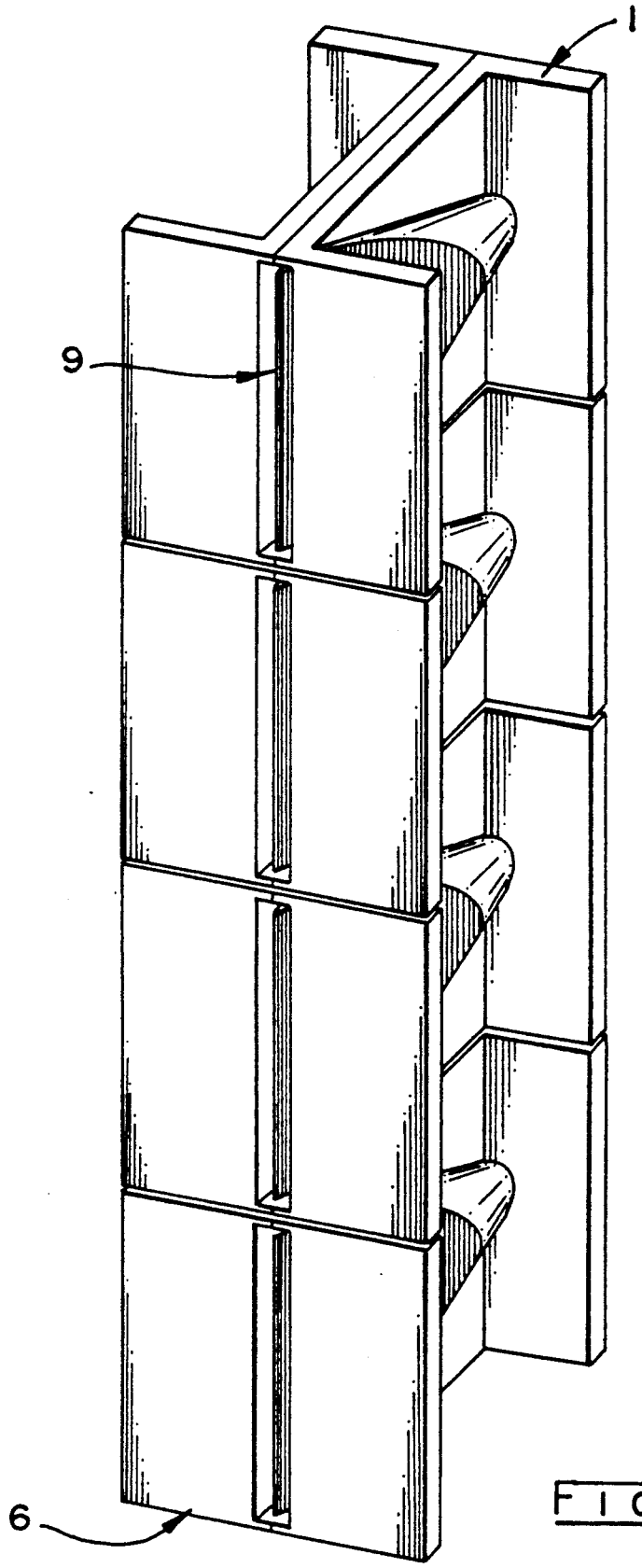
FIG. 13 is a perspective view of a plurality of aligned wave guides.

The grouping of a plurality of loudspeakers with wave guides in the vertical direction as seen in FIG. 13, side L being vertical has an effect to generate an isophase planar band from which a coherent cylindrical wave can emerge. An optimum coupling between the loudspeakers is thus achieved.

Although the invention has been described with reference to particular means, materials and embodiments, it is to be understood that the invention is not limited to what has been disclosed and extends to all equivalents within the scope of the claims.

What is claimed is:

1. A wave guide adapted to be placed at an output of an acoustic transducer, comprising a housing having an input orifice at one end of said housing and an output orifice at another end of said housing, wherein said housing comprises walls having an inner surface defining a conduit, said conduit expanding from said input orifice to said output orifice, said input orifice being substantially circular, said output orifice being substantially oblong and planar, guide means having an outer surface within said conduit and defining between said outer surface and said inner surface of said housing at least substantially constant length paths extended between said input orifice and said output orifice, for guiding sound waves from said acoustic transducer along said substantially constant length paths from said input orifice to said output orifice.

2. A wave guide according to claim 1 wherein said guide means comprises at least one internal body positioned within said conduit having a predetermined outer surface, and wherein said substantially constant length paths are defined by said outer surface of said at least one internal body and said inner surface of said housing.

3. A wave guide according to claim 2 wherein each of said substantially constant length paths has a width extending from said input orifice to said output orifice which is substantially constant from said input orifice to said output orifice.

4. A wave guide according to claim 1, wherein said wave guide transforms a circular isophase sound wave into a generally rectangular isophase sound wave.

5. A wave guide according to claim 1 wherein said input orifice is substantially annular in shape.

6. A wave guide according to claim 1 wherein a deviation in length between any two of said substantially constant length paths is not greater than one quarter of a highest frequency wavelength which is guided by said wave guide.

7. A wave guide according to claim 1 wherein said output orifice has a width which is not greater than a highest frequency wavelength which is guided by said wave guide.

8. A wave guide adapted to be placed at an output of an acoustic transducer, comprising two shells that are substantially symmetrical along a vertical plane and form a housing, each of said shells comprising a rear end and a front end, each of said shells further forming a hollow portion, a small cut-out portion at said rear end and a small cut-out portion at said front end, wherein upon connection of said two shells along said vertical plane of symmetry, said rear end cut-out portion of each of said shell together form a substantially circular input orifice, said front end cut-out portion of each of said shell together form a substantially oblong and planar output orifice and said hollow portion of each of said shells together form a conduit having a shape determined at least in part by an inner surface of said housing, said conduit expanding from said input orifice to said output orifice, guide means within said conduit defining, between an outer surface thereof and said inner surface, at least substantially constant length paths extending between said input orifice and said output orifice for guiding sound waves from said acoustic transducer along said substantially constant length paths from said input orifice to said output orifice, said guide means further comprising at least one internal body positioned within said conduit and spatially affixed to said inner surface.

9. A wave guide according to claim 8 wherein said rear end of each of said shells further comprise a rear side plate which radiate outwardly from said input orifice.

10. A wave guide according to claim 8 wherein said front end of each of said shells further comprise a front side plate which radiate outwardly from said input orifice.

11. A wave guide according to claim 8 in which said wave guide has an axis extending between a center of said input orifice and a center of said output orifice, said at least one internal body is shaped as a flattened cone, and is triangular in cross-section taken in a first predetermined plane, while comprising a shape of a flattened diamond, in a cross-section taken in a second plane perpendicular to said first predetermined plane, wherein said internal body has an end which penetrates into said input orifice and has a second end which is an edge located proximate and intermediate of said output orifice along said axis of said output orifice.

12. A wave guide according to claim 11 in which said conduit comprises a longitudinally extending axis, and wherein said at least one internal body is secured to said housing by means of at least one tongue which extends substantially parallel to said longitudinally extending axis of said conduit, so as to regularly maintain spacing between said inner surface of said housing and said at least one internal body.

13. A plurality of wave guides, adapted to be mounted in a line, wherein each wave guide comprises a housing having an input orifice at one end of said housing and an output orifice at another end of said housing, wherein said housing comprises walls having an inner surface defining a conduit, said conduit expanding from said input orifice to said output orifice, said input orifice being substantially circular, said output orifice being substantially oblong and planar, guide means having an outer surface within said conduit and defining between said outer surface and said inner surface of said housing at least substantially constant length paths extended between said input orifice and said output orifice, for guiding sound waves from said acoustic transducer along said substantially constant length paths from said input orifice to said output orifice and wherein said input orifice of each of said wave guides is mounted at a respective output of an acoustic transducer, in a manner such that said substantially oblong and planar output of each of said plurality of wave guides are located substantially in a vertical plane and in extension with each other.

14. A wave guide according to claim 13 wherein a deviation in length between any two of said substantially constant length paths is not greater than one quarter of a highest frequency wavelength which is guided by said wave guide.

15. A wave guide according to claim 13 wherein said output orifice has a width which is not greater than a highest frequency wavelength which is guided by said wave guide.

16. A device for directing energy, said energy being transmitted as a circular wave surface over a predetermined frequency spectrum, said device comprising:

(a) an input orifice for receiving said circular wave surface;

(b) an output orifice having a generally rectangular shape; and (c) at least one passage extending from said input orifice to said output orifice, said at least one passage having a predetermined dimension, for transforming said circular wave surface, received at said input orifice into a generally rectangular isophase wave planar surface, at said output orifice, over said predetermined frequency spectrum, wherein each said passage is defined by a conduit having an inner surface which expands from said input orifice to said generally rectangular output orifice and an outer surface of at least one internal body spatially affixed in said conduit said conduit comprising cut-out portions at a rear end fitted to define said input orifice, and a front end forming said generally rectangular output orifice.

17. A as in claim 16, further comprising a plurality of said devices aligned to create a wave surface having a shape of a planar ribbon, thus forming a coherent cylindrical progressive acoustic wave.

18. A device as in claim 16, wherein to said predetermined dimension of said at least one passage corresponds a time interval of energy propagation between said input orifice and said output orifice, said at least one passage being shaped in such a way that said time interval of energy propagation remains substantially constant.

19. A device as in claim 16, in combination with an acoustic energy source, said device having two ends, one end adapted to be fitted to said acoustic energy source, said acoustic energy source having an output which is a circular wave, and another end comprising said output orifice, which is substantially oblong and planar.

20. The device of claim 19, wherein said acoustic energy source comprises a loudspeaker having a compression chamber.

21. The device of claim 19, wherein said acoustic energy source comprises a loudspeaker having an annular diaphragm.

22. A device as in claim 16, wherein said at least one internal body has a shape of a generally flattened diamond along a horizontal plane, and a shape of a triangle along a vertical plane, spatially fixed to said conduit, said at least one passage having a width extending between said inner surface of said conduit and said outer surface of said at least one internal body.

23. A device as in claim 16, wherein said at least one internal body positioned between said input orifice and said output orifice, and said conduit defines said at least one passage to have a substantially constant width from said input orifice to said output orifice.

24. A device for directing acoustic energy from an acoustic source over a predetermined frequency spectrum, said device comprising:

(a) an input orifice for receiving said acoustic energy;

(b) an output orifice positioned at a predetermined distance from said input orifice, said output orifice having a generally rectangular shape;

(c) a housing positioned between said input orifice and said output orifice, said housing having an interior surface; and (d) at least one internal body positioned within said housing, said at least one internal body having an exterior surface, said interior surface of said housing and said exterior surface of at least one internal body defining at least one passage, said at least one passage having a length extending from said input orifice to said output orifice and a width extending between said interior surface of said housing and said exterior surface of said at least one internal body, said width of said at leastone passage being substantially constant along said length of said at lest one passage, the length of said at least one passage being being substantially constant along the width of said at least one passage.

25. The device of claim 24, wherein said at least one passage comprising a single annular passage and said at least one internal body comprising a single internal body.

26. The device of claim 25, further comprising at least one positioning member for maintaining said at least one internal body positioned within said housing.

27. The device of claim 26, wherein said at least one positioning member comprises a plurality of generally radially extending tongues spatially affixed between said interior surface of said housing and said exterior surface of said internal body.

28. The device of claim 24, wherein said at least one internal body has a longitudinal axis, extending between said input orifice and said output orifice, said exterior surface of said at least one internal body having at least one first portion extending from said input orifice toward said output orifice and diverging in a direction away from said longitudinal axis, and at least one second portion extending from said first portion toward said output orifice and converging toward said longitudinal axis.

29. The device of claim 28, wherein said at least one first portion of said exterior surface of said at least one internal body comprises a generally conical surface extending from said input orifice, and said at least one second portion of said exterior surface of said at least one internal body comprising a pair of generally planar surfaces on opposite sides of said longitudinal axis, said pair of generally planar surfaces intersecting with said generally conical surface.

30. The device of claim 29, wherein said generally rectangular shape of said output orifice has a generally vertically extending length and a generally horizontally extending width, said pair of generally planar surfaces being generally vertical.

31. The device of claim 30, wherein said generally planar surfaces converge toward said output orifice to a generally vertically extending edge at said output orifice.

32. The device of claim 28, wherein said housing has a longitudinal axis coinciding with said longitudinal axis of said at least one internal body, said interior surface of said housing having at least one first portion extending generally parallel to said at least one first portion of said at least one internal body, and at least one second portion extending generally parallel to said at least one second portion of said at least one internal body.

33. The device of claim 28, wherein said at least one first portion of said exterior surface of said at leastone internal body intersects with said at least one second portion of said exterior surface of said at least one internal body, in a horizontal plane extending through said longitudinal axis, at a point approximately one-half said predetermined distance between said input orifice and said output orifice.

34. The device of claim 24, wherein said at least one internal body comprises a single internal body having: (i) a generally triangular vertical cross-section with an apex proximate said input orifice and a generally vertically extending base proximate said output orifice and (ii) a generally diamond-shape horizontal cross-section with a first apex proximate said input orifice and a second apex proximate said output orifice.

* * * * *